United States Patent [19]

Wade et al.

[11] Patent Number: 4,781,157

[45] Date of Patent: Nov. 1, 1988

[54] MULTIPART CERAMIC CYLINDER HEAD

[75] Inventors: Wallace R. Wade, Farmington Hills; Edwin J. Ounsted, Dearborn, both of Mich.

[73] Assignee: Ford Motor Company, Dearborn, Mich.

[21] Appl. No.: 137,781

[22] Filed: Dec. 24, 1987

[51] Int. Cl.[4] ..... F02B 75/08

[52] U.S. Cl. ..... 123/193 H; 123/41.71

[58] Field of Search ..... 123/193 H, 41.71, 41.82

[56] References Cited

U.S. PATENT DOCUMENTS

| | | | |
|---|---|---|---|
| 599,496 | 2/1898 | Fraser | 123/41.82 |
| 4,508,066 | 4/1985 | Hartsock | 123/41.82 A |
| 4,646,692 | 3/1987 | Deuber et al. | 123/193 H |

FOREIGN PATENT DOCUMENTS

| | | |
|---|---|---|
| 58-210341 | 7/1983 | Japan . |
| 59-122765 | 7/1984 | Japan . |

OTHER PUBLICATIONS

"Adiabatic Diesel Engine Development at Ford Motor Company", Havstad et al., 1987, (Nov. 7, 1987) SAE Publication.

*Primary Examiner*—E. Rollins Cross

*Attorney, Agent, or Firm*—Joseph W. Malleck; Roger L. May

[57] ABSTRACT

A multipart ceramic cylinder head construction, comprises: a ceramic plate having (i) opposed faces, (ii) a central zone through which extends a transverse central axis, (iii) a peripheral zone about the central zone, the plate further having three or more gas or fluid transfer openings extending transversely through the central zone and spaced about the central axis to divide the central zone into radial sectors, each sector containing one of the openings; a first ceramic intake port block having sufficient ceramic mass to define a gas passage and define an integral compression receiving portion, the first block being adapted to mate with one of the radial sectors of the plate to align the first passage with the opening in such one radial sector; a second ceramic exhaust port block having sufficient ceramic mass to define a second gas passage and define an integral compression receiving portion, the second block being adapted to mate with another of the radial sectors of the plate to align such second passage with the opening in such other radial sector; and means effective to (i) secure the blocks mated to the plate in compression, and (ii) provide an air gap spacing between the blocks.

8 Claims, 5 Drawing Sheets

Fig. 1.
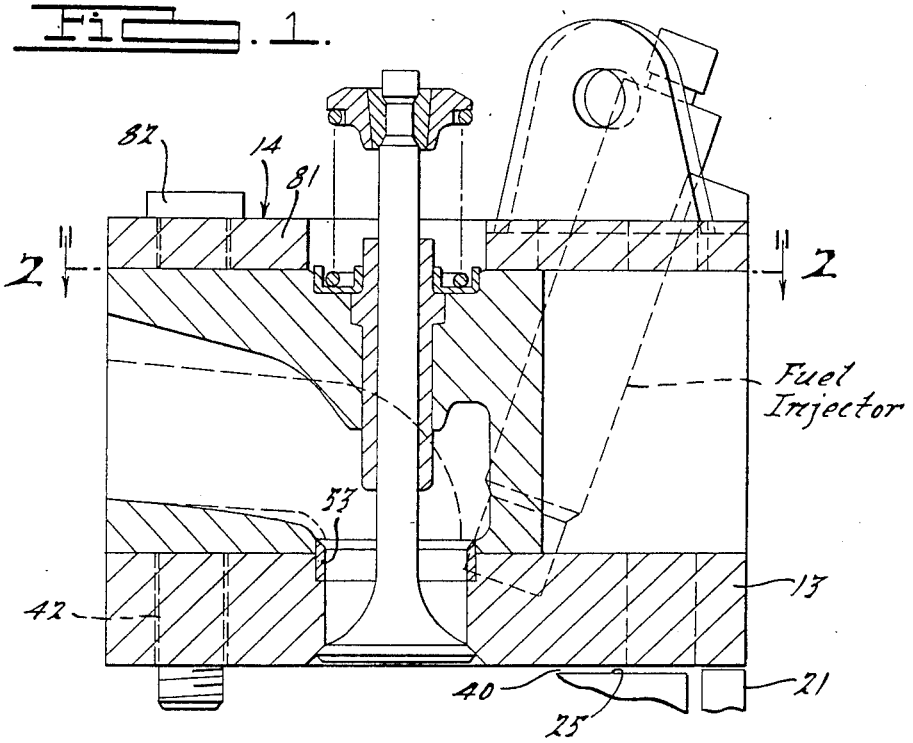
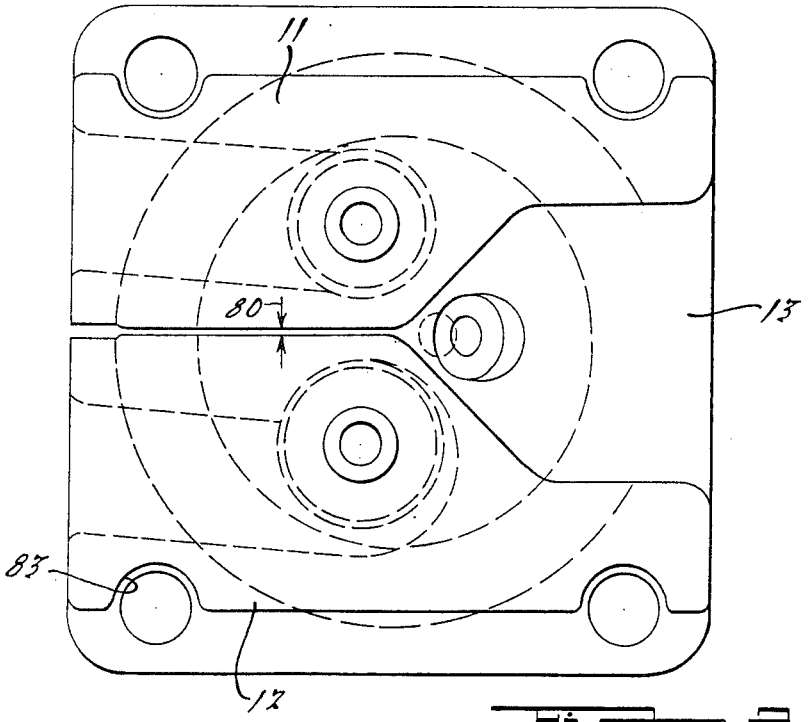
Fig. 2.

FIG. 3.
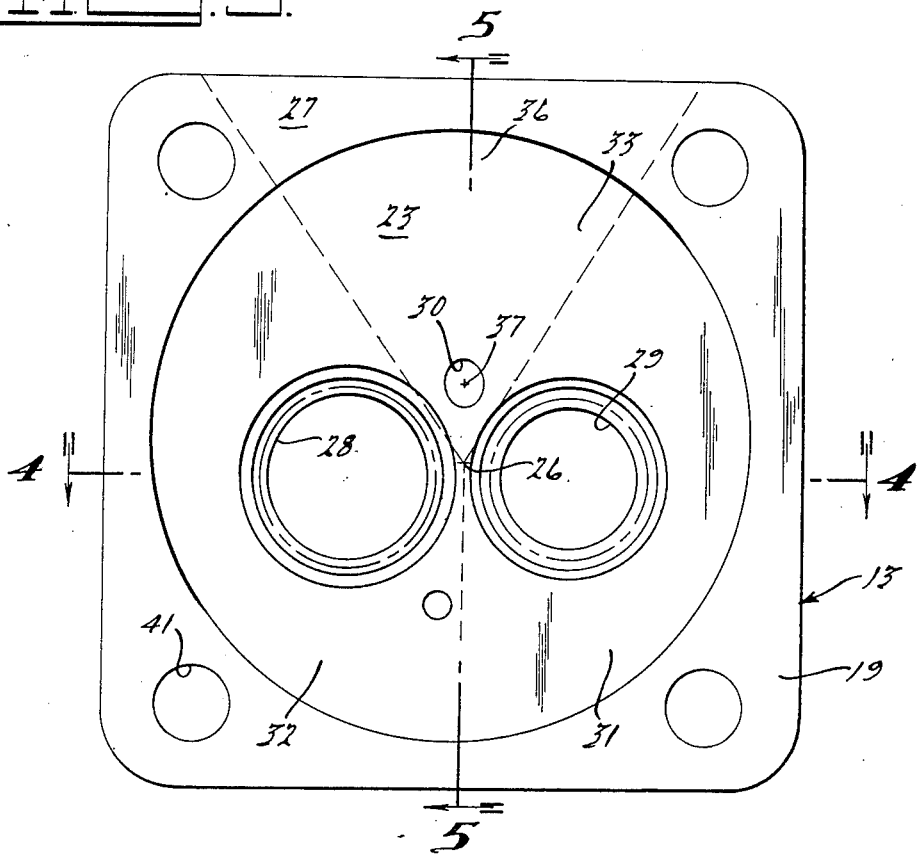
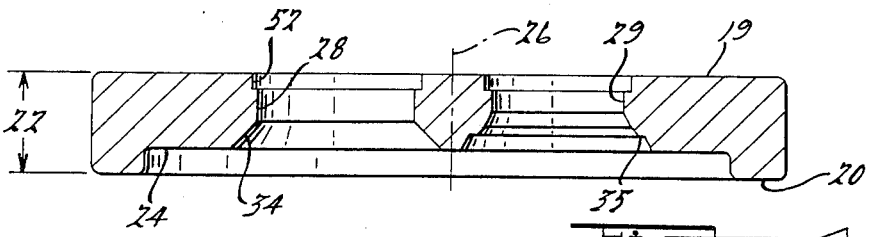
FIG. 4.
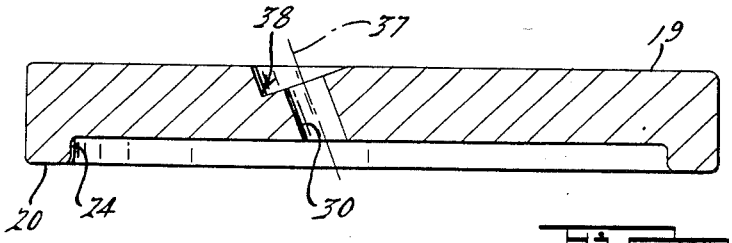
FIG. 5.

MULTIPART CERAMIC CYLINDER HEAD

BACKGROUND OF THE INVENTION

1. Technical Field

This invention relates to the art of making ceramic cylinder heads.

2. Description of the Prior Art

As described in a 1987 article, entitled "Adiabatic Diesel Engine Development at Ford Motor Company", by Havstad et al, the desire to achieve an adiabatic engine has brought with it a technical evolution in the use of structural ceramics. Structural ceramics are to be differentiated from ceramics used in catalyst substrates, electronic substrates and china, principally on the basis that they are strong in compression and have moderately high strength in tension. Ceramics are traditionally stable at high temperatures, maintaining high hardness, stiffness and resistance to corrosion. An adiabatic engine is one which operates at consistently high temperatures without a cooling system. Such an engine achieves work through variations in pressure and volume with little heat transfer.

Thin ceramic films or coatings have been used on metal engine components to achieve the introduction of ceramics in an adiabatic engine. This has evolved into the use of thicker ceramic inserts or linings, which are cast in place in the supporting structural metal component or attached in some other satisfactory manner (see Japanese patent 122765; U.S. Pat. No. 599,496 is an exception to this evolutionary trend since as early as 1898, porcelain, not a structural ceramic, was used as a forerunner of such ceramic liners). The last evolutionary stage is to eliminate substantially structural metal, using ceramic as the primary structural member.

Turning specifically to the cylinder head component design, we find that the same evolutionary transition has been taking place. The cylinder head is used herein to mean that member which primarily forms the roof of a combustion chamber and secondarily provides passages for ingress and egress of gases or fluids through such roof for the combustion chamber. Attempts to use ceramic as a structural member have visualized the ceramic primarily as a substitute for the typically well-known metal counterpart. The ceramic was typically used as a monolithic solid piece, with cast in place passages and openings, including passages to receive liquid fuel injectors or electrical igniters (see U.S. Pat. No. 4,508,066 and Japanese Pat. No. 210341).

A unitary ceramic head is very difficult to fabricate and inhibits the ceramic molding technique to that which is more expensive and time consuming. Moreover, solid ceramic heads permit some undesirable heat transfer between the exhaust and intake passages, and some undesirable heat transfer to the fuel injectors.

It would be desirable if a ceramic head could be designed or built from simple geometric blocks or plates with some means providing an air gap or separation between such parts to facilitate insulation of heat transfer between the gas and fluid passages.

SUMMARY OF THE INVENTION

The invention is a multipart ceramic cylinder head for an internal combustion engine, comprising: (a) a ceramic plate having a central zone through which a central axis extends transversely therethrough, a peripheral zone surrounding the central zone, and opposed flat faces through which the central axis extends, the plate having three or more gas and/or fluid transfer openings in the central zone spaced about the central axis of the plate, each in a different sector of the plate; (b) a first ceramic intake port block having sufficient ceramic mass to define a first gas passage and define an integral compression receiving portion, the first block being adapted to mate with one of the radial sectors of the plate to align the first passage with the opening in the one radial sector; (c) a second ceramic port block having sufficient ceramic mass to define a second gas passage and define an integral compression receiving portion, the second block being adapted to mate with another of sad radial sectors of the plate to align the second passage with the opening in the other radial sector; and (d) means effective to (i) secure the blocks mated to the plate in compression, and (ii) provide an air gap spacing between the blocks.

SUMMARY OF THE DRAWINGS

FIG. 1 is a sectional elevational view (taken along a plane through the intake port) of a ceramic head embodying the principles of this invention;

FIG. 2 is a sectional plan view taken along line 2—2 of FIG. 1;

FIG. 3 is a plan view of a ceramic plate constituting one part of the multipart head assembly;

FIGS. 4 and 5 are sectional views taken along, respectively, lines 4–4 and 5–5 of FIG. 3;

DETAILED DESCRIPTION AND BEST MODE

Figure 6:
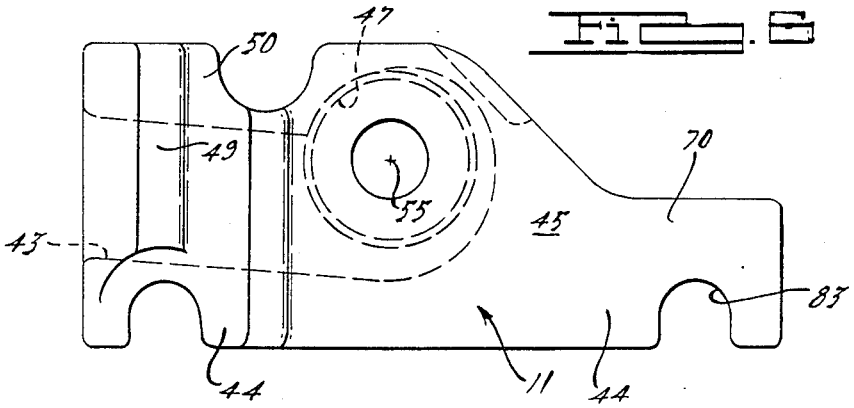
FIG. 6 is a plan view of the intake port block constituting another part of the multipart ceramic head assembly.

It is the intent of this invention to use simple geometric blocks or plates as parts for constructing a multipart ceramic head. One block each is adapted to contain either an intake or an exhaust gas passage, such blocks being mated with and resting on a sector of the ceramic plate. The blocks and plate are placed in compression and secured to the remainder of the engine housing by a rigid plate and fasteners extending around or through such assembly.

The ceramic materials for which such simple geometric parts may be comprised can be selected from any refractory material that is capable of withstanding the extreme temperatures experienced during the operation of an internal combustion engine without liquid cooling. Preferably, the ceramic parts are comprised of sintered silicon nitride, the parts being injection molded prior to sintering. Other ceramics that may be useful may include the aluminas, silicates, nitrides, carbides, zirconias, or even cermets.

Silicon nitride frequently experiences a shrinkage up to 20% by volume as a result of sintering. It is important that wall thicknesses which define the intake and exhaust passages be relatively uniform to prevent nonuniform shrinkage of the walls, leading to a destruction of critical flow design configurations for the gas passages. By separating the ceramic portions of the head into parts, there is greater control of the shrinkage resulting in greater tolerance control of the necessary critical surfaces, and there is enhanced ease of fabrication by reducing the number of passages or openings within a single part.

As shown in FIGS. 1 and 2, the multipart ceramic head assembly 10 is comprised of two blocks 11 and 12 superimposed and supported on a plate 13; securing and aligning means 14 is used to place such ceramic assembly in compression. Additional attachments 15,16 may be arranged as part of the securing means 14 to mount other structure 17,18 for the operation of the engine.

Plate

As shown in FIGS. 3–5, the ceramic plate 13 essentially has a pair of opposed flat surfaces 19 and 20, one constituting its top and the other constituting its bottom which faces the cylinder block 21 for the engine. The height 22 of the ceramic plate is generally uniform (in the range of about 0.5–0.75 inches or 12–20 mm) except for a recess 24 for aligning with the cylinder block 21, the piston 25 and combustion chamber 40. The plate 13 has a central zone 23 through which a transverse central axis 26 extends, and a peripheral zone 27 which surrounds the central zone. Three major openings 28,29,30 are defined in the central zone of such plate and are spaced about the axis 26 in radial sectors 31,32,33 (as generally indicated by dashed lines in FIG. 3), each sector containing only one of the openings. Two of the major openings consist of a cylindrical bore 28,29 for each of the exhaust valve seat 34 and for the intake valve seat 35. These cylindrical bores are placed on opposite sides of a plane 36 which bisects the plate therebetween and which extends through the central axis 26 of the plate. The third opening 30 is provided with an axis 37 inclined relative to the axis 26 of the plate; the opening 30 is stepped to receive a fuel injector tip (or head), whereby an annular flat surface 38 is provided for seating the body of the fuel injector. The axis 37 of the third opening intersects the top surface 19 of the plate at a location which generally lies on a plane 36 midway between openings 28 and 29.

The peripheral zone 27 resides radially outside the recessed area and contains openings 41 through which compression fastening members 42 may extend.

Blocks

Figure 7:
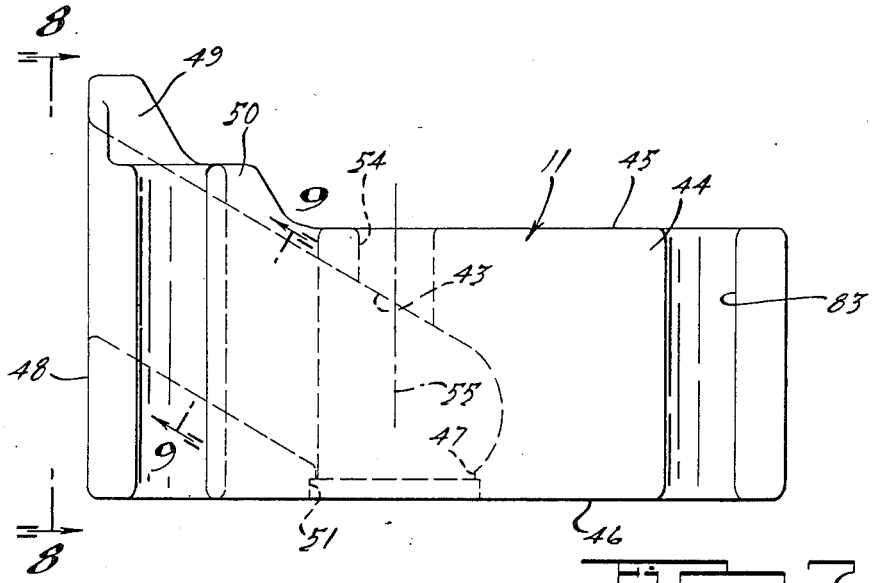
FIG. 7 is a sectional elevational view of the structure in FIG. 6, taken along line 7—7 thereof.
Figure 8:
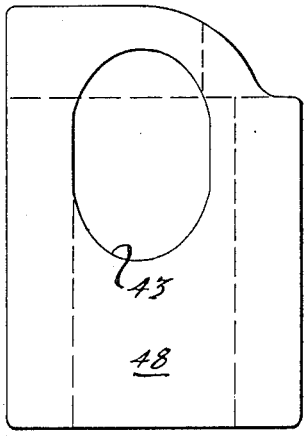
FIGS. 8 and 9 are views taken, respectively, along lines 8—8 and 9—9 of FIG. 7.

As shown in FIGS. 6–9, a first ceramic intake port block 11 is formed with sufficient ceramic mass to define a gas passage 43 as well as to define an integral compression receiving portion 44. As shown in FIG. 7, the block 11 has a shape to minimize ceramic mass and has opposed parallel flat top and bottom surfaces 45,46. Surface 46 is adapted to mate with the flat top surface 19 of the plate 13. Significantly, the intake port block is adapted to mate with one of the radial sectors 32 only of the plate in a manner to align the passage 43 with the opening 28 in the one radial sector 32.

The passage 43 extends from the bottom side 46 of the block mateable with the plate and intersects such surface 46 to define a first opening 47 in such bottom side 46. The passage 43 extends on an incline to intersect with a upright side wall 48 of the block. In certain engine designs, the configuration of the passage 43 may require a large inclination with respect to the horizontal surface of the plate. To accommodate this in a given height block, ceramic steps 49,50 may be incorporated adjacent the side wall 48 to permit the passage to extend at an increased inclination.

To insure accurate alignment of the mating opening 47 of the intake port block with the opening 28 in the plate, annular grooves 51,52 are provided about the opening 47,28 of the port block and plate to receive a metallic sleeve 53 (sleeve 53 is split to prevent damage due to expansion of sleeve) which facilitates such alignment during assembly. It may also be possible to mold such sleeve integrally of ceramic as part of the formation of either the plate or the block.

The intake port block passage 43 may further be defined to include a valve stem opening 54 intersecting with the main passage 43 and having an axis 55 aligned with the axis of the block opening 47.

As shown in FIGS. 10–13, a second ceramic exhaust port block 12 is formed, again having sufficient ceramic mass to define an exhaust passage 56. The exhaust port block is adapted to mate with another of the radial sectors 31 of the plate 13 in a manner to align the passage 56 with another of the openings 29 in radial sector 31. Similarly, the passage 56 may further comprehend a valve stem guide opening 57 which has an axis 58 intersecting with the passage 56 and aligned with the axis 59 of the opening 60 of the passage which interrupts the bottom face 61 of the block. Again, an annular groove 62 is placed in the opening 60 to receive a metal sleeve 53 for alignment. The passage 56 intersects with side walls 64 to define intake opening 65.

In each instance for such blocks, the minimum mass for defining the block may consist of a ceramic wall which is uniformly thick at about ¼ inch and may be defined by suitable injection molding techniques. Vertical ribs or bosses 44 may be integrally defined alongside such thin walls of the block to receive compression forces.

Figure 9:
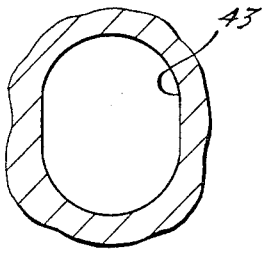
Figure 10:
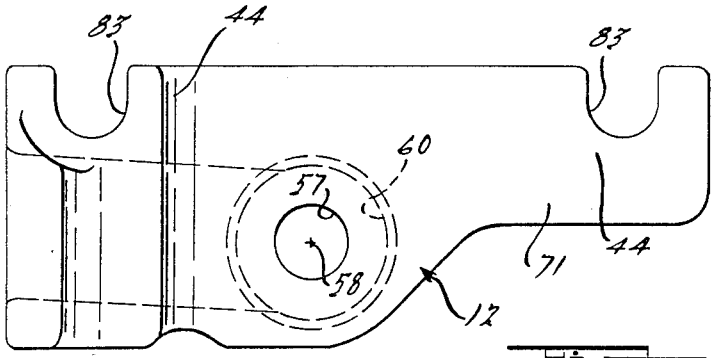
FIG. 10 is a plan view of the exhaust port block constituting still another part of the multipart ceramic head assembly.
Figure 11:
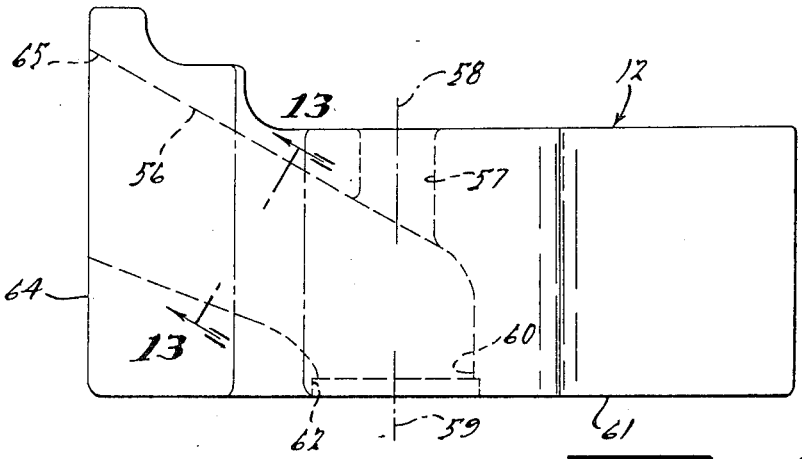
FIG. 11 is a sectional elevational view of the structure in FIG. 10, taken along line 11—11 thereof.
Figure 12:
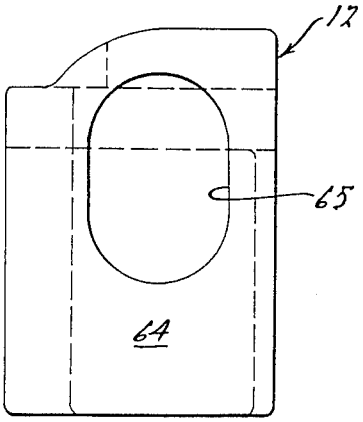
FIGS. 12 and 13 are views taken, respectively, along lines 12—12 and 13—13 of FIG. 11.
Figure 13:
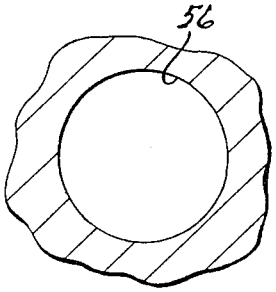
Figure 14:
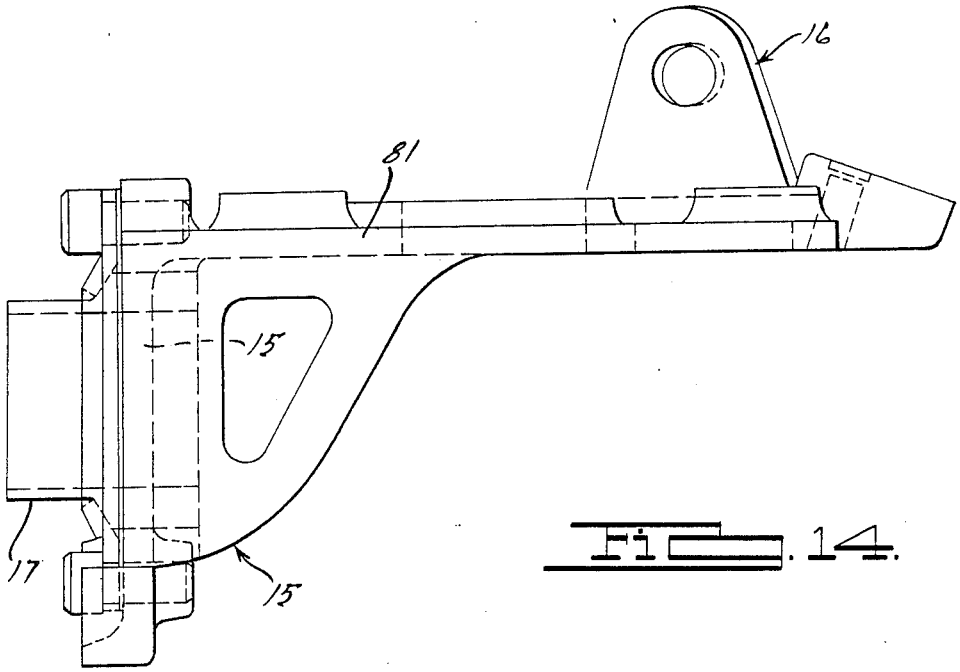
FIG. 14 is a side elevational view of a metal plate used to secure the ceramic blocks.
Figure 15:
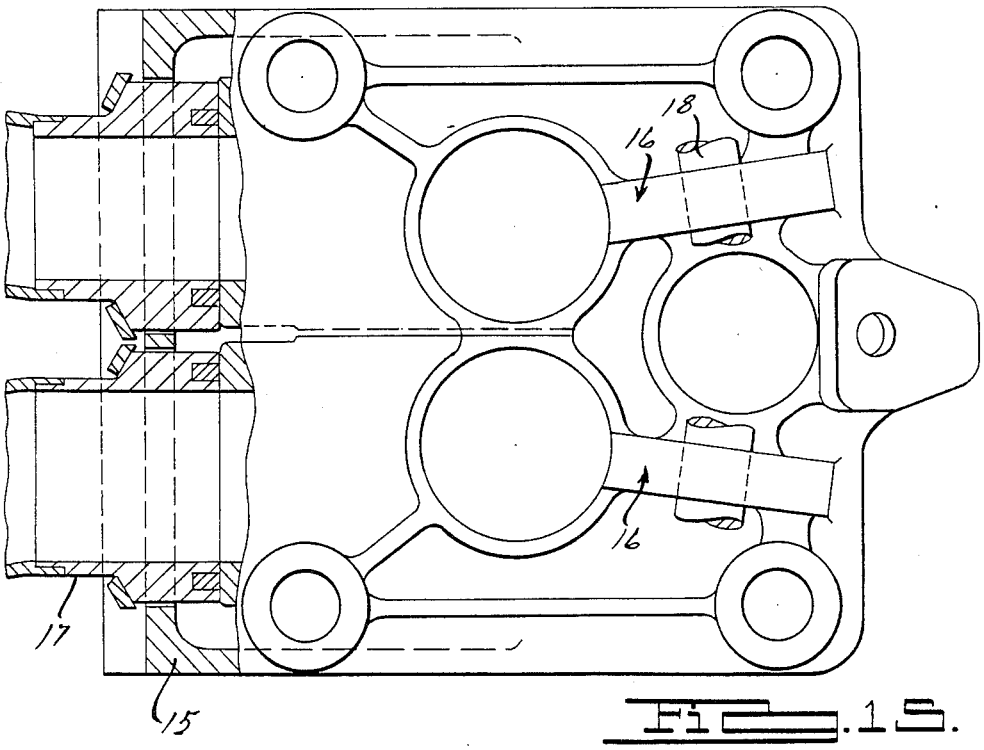
FIG. 15 is a plan view of structure shown in FIG. 14.

The mass of ceramic shown in FIGS. 6 and 10 define blocks having upright side walls providing greater wall thickness surrounding the intake passage which may vary between ¼ inch to as much as 1 inch in thickness. These side walls perform as integral compression receiving portions. As shown in FIGS. 6 and 10, each block may have extension 70,71 which would extend essentially along a peripheral portion of the plate to provide an adequate compression surface. The cross-sectional configuration of the interior of the intake passage 43 may be elliptical, as shown in FIG. 9, and the interior configuration of the exhaust port 56 may be circular, as shown in FIG. 13.

Securing and Aligning Means

The blocks 11 and 12 are stationed on top of the plate 13 in a manner to provide a separation gap 80 (see FIG. 2) therebetween of about 1–3 mm or preferably 0.06 inches. Such gap serves at least two purposes, the first of which is to avoid contact between such blocks at critical surfaces which would require machining and extra expense, and secondly, to provide an insulating space between such blocks to prevent transfer of heat from the exhaust passage to the intake passage.

To precisely locate such blocks on the plate, independent locating sleeves 53 are used to fit snugly within receptacles or annular grooves 51,52,62 about the openings of the passages in each of the mating blocks and plate.

The securing and aligning means 14 is effective to secure the blocks to said plate in compression. To this end, a rigid plate 81 is superimposed over the assembly of the blocks; compression bolts 42 having their heads 82 secured against the outer surface of the rigid plate 81 and having their shanks extend either adjacent to or through the peripheral zone 27 of the ceramic plate. The bolt shanks may extend along grooves 83 in each of the sides of the blocks to allow the bosses or ribs 44 to be as close as possible to the bolts. The other extremities of such bolts 82 may be threaded and secured to metallic or other members of the engine housing to which the head is attached, such as the block 21.

The rigid plate 81 may further be configured to provide attachments for other related valvetrain components. To this end, the rigid plate may have attachments 16 in form of upstanding fulcrum members to mount a valvetrain 18, as shown in FIG. 2. The plate may further be defined to have an attachment 15 in the form of a depending side wall extending along the outer side wall surfaces 48 and 79 respectively, of the blocks, to act as a metallic surface against which exhaust and intake manifolds 17 may be securely attached. Such rigid plate 81 may be constructed of either cast aluminum or iron-based material.

While particular embodiments of the invention have been illustrated and described, it will be obvious to those skilled in the art that various changes and modifications may be made without departing from the invention, and it is intended to cover in the appended claims all such modifications and equivalents as fall within the true spirit and scope of the invention.

We claim:

1. A multipart ceramic cylinder head construction, comprising:

(a) a ceramic plate having (i) opposed faces, (ii) a central zone through which extends a transverse central axis, (iii) a peripheral zone about said central zone, said plate further having three or more gas or fluid transfer openings extending transversely through said central zone and spaced about said central axis, each in a different radial sector of the plate;

(b) a first ceramic intake port block having sufficient ceramic mass to define a gas passage and define integral compression receiving portion, said first block being adapted to mate with one of said radial sectors of said plate to align said first passage with the opening in said one radial sector;

(c) a second ceramic exhaust port block having sufficient ceramic mass to define a second gas passage and define an integral compression receiving portion, said second block being adapted to mate with another of said radial sectors of said plate to align said second passage with the opening in said another radial sector; and (d) means effective to (i) secure said blocks mated to said plate in compression, and (ii) provide an air gap spacing between said blocks.

2. The construction as in claim 1, in which said ceramic plate is defined by opposed flat surfaces.

3. The construction as in claim 1, in which the passages in each of said blocks further comprises a valve stem guide opening having an axis intersecting with a portion of said passage.

4. The construction as in claim 1, in which said openings are equi-spaced about said central axis of the plate.

5. The construction as in claim 1, in which the thickness of said plate is in the range of 0.5–0.75 inches (12–20 mm), and the thickness of said walls of each said block is in the range of 0.25–1.0 inches.

6. The construction as in claim 1, in which said securing means comprises fasteners and has a plurality of openings in the peripheral zone of said plate through which extend said fasteners to carry out said securement.

7. The construction as in claim 1, in which said securing means further comprises metallic insert sleeves effective to fit in complementary grooves of said plate, sleeves extending above the top surface of said plate to mate with similar complementary grooves in the matable blocks.

8. The construction as in claim 1, in which the air gap spacing between said blocks is in the range of 1–3 mm.

* * * * *